US010046341B2

(12) United States Patent
Wu et al.

(10) Patent No.: US 10,046,341 B2
(45) Date of Patent: Aug. 14, 2018

(54) SHOWER SYSTEM COMBINING A TOP SPRAYER AND A HAND SHOWER

(71) Applicants: XIAMEN SOLEX HIGH-TECH INDUSTRIES CO., LTD., Xiamen, Fujian (CN); Huasong Zhou, Xiamen, Fujian (CN)

(72) Inventors: Yulin Wu, Xiamen (CN); Wenbin Fan, Xiamen (CN); Bin Cao, Xiamen (CN); Huasong Zhou, Xiamen (CN)

(73) Assignee: XIAMEN SOLEX HIGH-TECH INDUSTRIES CO., LTD., Xiamen (CN)

( * ) Notice: Subject to any disclaimer, the term of this patent is extended or adjusted under 35 U.S.C. 154(b) by 179 days.

(21) Appl. No.: 14/150,208

(22) Filed: Jan. 8, 2014

(65) Prior Publication Data

US 2015/0115064 A1 Apr. 30, 2015

(30) Foreign Application Priority Data

Oct. 25, 2013 (CN) ..... 2013 1 0513988
Oct. 25, 2013 (CN) ..... 2013 2 0666083 U

(51) Int. Cl.

| | |
|---|---|
| ***B05B 1/18*** | (2006.01) |
| ***B05C 1/02*** | (2006.01) |
| ***E03C 1/04*** | (2006.01) |
| ***B05B 1/30*** | (2006.01) |

(52) U.S. Cl.

CPC ..... *B05B 1/185* (2013.01); *B05B 1/3026* (2013.01); *E03C 1/0408* (2013.01); *E03C 1/0409* (2013.01)

(58) Field of Classification Search

CPC ..... B05B 1/18; B05B 1/185; E03C 1/025
USPC ..... 239/237, 443
See application file for complete search history.

(56) References Cited

U.S. PATENT DOCUMENTS

| | | | | |
|---|---|---|---|---|
| 6,594,832 | B2 * | 7/2003 | Yang | A47K 3/28 239/283 |
| 7,219,376 | B1 * | 5/2007 | Zhou | E03C 1/06 239/280.5 |
| 7,360,723 | B2 * | 4/2008 | Lev | B05B 1/16 239/442 |
| 7,458,112 | B1 * | 12/2008 | Yang | E03C 1/0408 137/625.47 |
| 7,918,424 | B1 * | 4/2011 | Wu | E03C 1/06 239/587.1 |
| 2007/0022528 | A1 * | 2/2007 | Gilbert | B05B 1/18 4/615 |

(Continued)

FOREIGN PATENT DOCUMENTS

| | | | | |
|---|---|---|---|---|
| WO | WO2012/050894 | * | 4/2012 | A47K 3/28 |

*Primary Examiner* — Chee-Chong Lee
(74) *Attorney, Agent, or Firm* — Rabin & Berdo, P.C.

(57) ABSTRACT

A shower system includes a top sprayer with at least two water types and a hand shower. The top sprayer is disposed with an inlet waterway to connect to the water source and first diversion waterways corresponding to the water types one by one; wherein the top sprayer is further disposed with a second diversion waterway, the hand shower is connected to the second diversion waterway by an external flexible pipe; the top sprayer is disposed with a switch mechanism, the switch mechanism is cooperated to the inlet waterway, the first diversion waterways and the second diversion waterway to switch the waterways, thus switching any diversion waterway to connect to the inlet waterway.

10 Claims, 7 Drawing Sheets

(56) References Cited

U.S. PATENT DOCUMENTS

2008/0073446 A1* 3/2008 Zhou ..... B05B 1/185
239/289
2009/0007330 A1* 1/2009 Genord ..... B05B 1/18
4/695

* cited by examiner

SHOWER SYSTEM COMBINING A TOP SPRAYER AND A HAND SHOWER

FIELD OF THE INVENTION

The present invention relates to a shower system combining a top sprayer and a hand shower.

BACKGROUND OF THE INVENTION

Existing shower system combining a top sprayer and a hand shower comprising a top sprayer with at least two water types, a hand shower and a first switch mechanism, the first switch mechanism is used to switch the top sprayer or the hand shower to connect to the inlet waterway, then water flows out of the hand shower or the top sprayer. The top sprayer is disposed with a second switch mechanism to switch the different water types. The shower system is disclosed with a first switch mechanism and a second switch mechanism, it has disadvantages as below: 1. to choose a water type of the top sprayer, it needs to switch the first switch mechanism then the second switch mechanism, which makes it complex to switch; 2. it thus increases manufactory cost; 3. it takes big apace with big size.

SUMMARY OF THE INVENTION

The present invention is provided with a shower system combining a top sprayer and a hand shower, which overcomes the disadvantages of the existing shower system.

The technical proposal of the present invention is as below:

A shower system combining a top sprayer and a hand shower, comprising a top sprayer with at least two water types and a hand shower, the top sprayer is disposed with an inlet waterway to connect to the water source and first diversion waterways corresponding to the water types one by one; wherein the top sprayer is further disposed with a second diversion waterway, the hand shower is connected to the second diversion waterway by an external flexible pipe; the top sprayer is disposed with a switch mechanism, the switch mechanism is cooperated to the inlet waterway, the first diversion waterways and the second diversion waterway to switch the waterways, thus switching any diversion waterway to connect to the inlet waterway.

In another preferred embodiment, the top sprayer comprising a fixed portion, the switch mechanism comprising a water diversion body fixed inside the fixed portion and a water diversion plate; the water diversion body is disposed with at least two first water diversion openings connected to the at least two first diversion waterways and a second water diversion opening connected to the second diversion waterway; the water diversion plate is fixed with a fixing shaft, the water diversion plate is disposed with a throughout water diversion hole, the water diversion hole is connected to the inlet waterway, the water diversion hole is connected to the inlet waterway; the water diversion plate is rotatably connected inside the water diversion body in sealing way, the fixing shaft is rotatably extended out of the water diversion body in sealing way, a knob partially outside the fixed portion is further disposed, the knob is coaxially fixed to the fixing shaft, the fixing shaft, when rotating, drives the water diversion plate to rotate, thus making the water diversion hole to switch to connect to the first water diversion openings or the second water diversion opening.

In another preferred embodiment, the water diversion body is disposed with a concave cavity, the water diversion plate is disposed inside the concave cavity, the fixing shaft passes through the bottom surface of the concave cavity and extends out of the water diversion body; the top sprayer is further disposed with a press base, the press base is assembled to the concave cavity of the water diversion body, the water diversion plate is disposed between the bottom surface of the concave cavity and the press base, a spring abuts between the press base and the water diversion plate; the press base is disposed with through hole inside, the inlet waterway comprising the through hole.

In another preferred embodiment, the fixed portion comprising a top sprayer front cover and a top sprayer back cover, the top sprayer front cover is fixed to the top sprayer back cover face to face, the water diversion body is disposed between the top sprayer front cover and the top sprayer back cover.

In another preferred embodiment, the fixed portion comprising outlet components, the outlet components comprising outlet portions corresponding to the water types one by one, the first diversion waterway is a first internal flexible pipe, the first internal flexible pipe is connected to the first water diversion opening and the outlet portions.

In another preferred embodiment, the top sprayer is disposed with a joint, the second diversion waterway is a second internal flexible pipe, the second internal flexible pipe is connected to the second water diversion opening and the joint, the external flexible pipe is connected to the joint.

In another preferred embodiment, the top sprayer is assembled to a hanging arm, the inlet waterway is connected to the internal hole of the hanging arm In another preferred embodiment, the top sprayer is disposed with a coupled surface to couple to the hand shower, the top sprayer is disposed with a first magnetic unit inside, the hand shower is disposed with a second magnetic unit, the attraction of the first magnetic unit and the second magnetic unit makes the hand shower attracted to the coupled surface of the top sprayer.

In another preferred embodiment, the fixed portion comprising a top sprayer front cover and a top sprayer back cover, the top sprayer front cover is fixed to the top sprayer back cover face to face, the coupled surface is disposed in the front side of the top sprayer front cover, the back side of the top sprayer front cover corresponding to the coupled surface is disposed with a first accommodating base, the first magnetic unit is disposed inside the first accommodating base; the hand shower is disposed with a back cover, the internal side of the back cover is disposed with a second accommodating base, the second magnetic unit is disposed inside the second accommodating base.

In another preferred embodiment, the coupled surface is coupled to the back cover of the hand shower.

Compared to the existing technology, the technical proposal of the present invention has advantages as below:

1. the switch mechanism is integrated to the top sprayer to couple to the inlet waterway, the first diversion waterway and the second diversion waterway to realize switch of waterways, only one switch mechanism is disposed to switch the water types of the top sprayer and the hand shower to discharge water, the switch is convenient and fast, it reduces the cost, the structure is simple with outstanding style.

2. the water diversion plate is rotatably connected inside the water diversion body in sealing way, the shaft, when rotating, drives the water diversion plate to rotate, thus making the water diversion hole switched to connected to the water diversion openings, the switch is labor saving and convenient.

3. the press base is assembled to the concave cavity of the water diversion body, a spring abuts between the press base and the water diversion plate, which ensures the sealing performance.

4. the first diversion waterway is a first internal flexible pipe, which is connected to the first water diversion openings and the outlet portion, the structure is simple, and it reduces the cost of mold, the assembly is convenient.

5. the top sprayer is disposed with a coupled surface coupled to the hand shower, the top sprayer is disposed with a first magnetic unit inside; the hand shower is disposed with a second magnetic unit, with the attraction of the first magnetic unit and the second magnetic unit, the hand shower can be attracted to the coupled surface of the top sprayer, so that it saves a traditional socked, which reduces the manufactory cost, it is provided with tight structure and well appearance, it is convenient to put the hand shower back or get the hand shower down, besides, when the hand shower is attracted to the coupled surface of the top sprayer, the hand shower can be serviced as a top shower, so that it can be used in two types.

6. the back side of the top sprayer front cover is disposed with a first accommodating base, the first magnetic unit is disposed inside the first accommodating base, then internal surface of the back cover of the hand shower is disposed with a second accommodating base, the second magnetic unit is disposed inside the second accommodating base, the structure is tight, the appearance is beautiful, and the attractive force is strong.

7. the coupled surface is coupled to the back cover of the hand shower, thus making it tightly attracted.

BRIEF DESCRIPTION OF THE DRAWINGS

The present invention will be further described with the drawings and the embodiments.

DETAILED DESCRIPTION OF THE EMBODIMENTS

Please refer to FIG. 1 to FIG. 10, a shower system combining a top sprayer and a hand shower comprising a top sprayer 100 with at least two water types and a hand shower 200. In this embodiment, the top sprayer 100 has two water types, but not limited to this, it can have three or more water types. As needed, if the hand shower has several water types, it can be disposed with a switch mechanism to control the water types.

Figure 1:
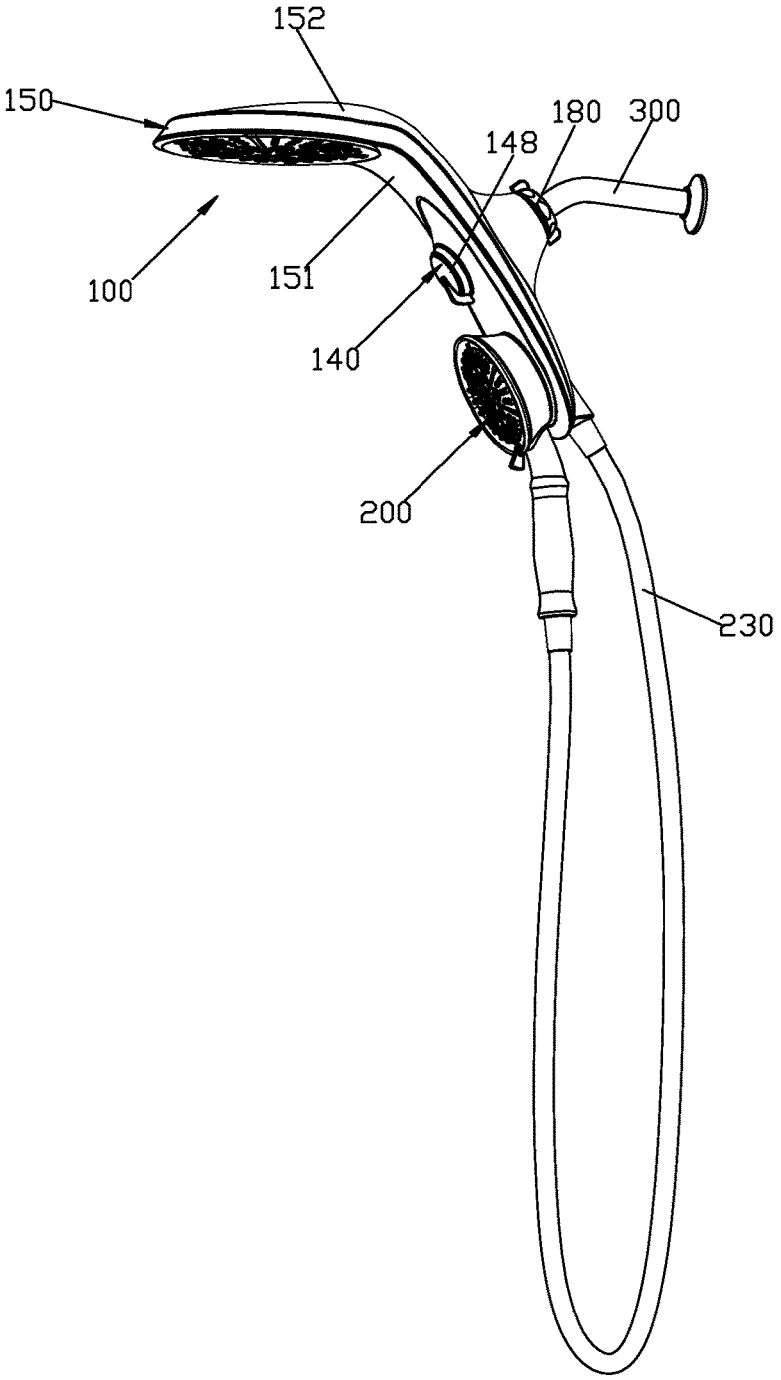
FIG. 1 illustrates a schematic diagram of the shower system.
Figure 2:
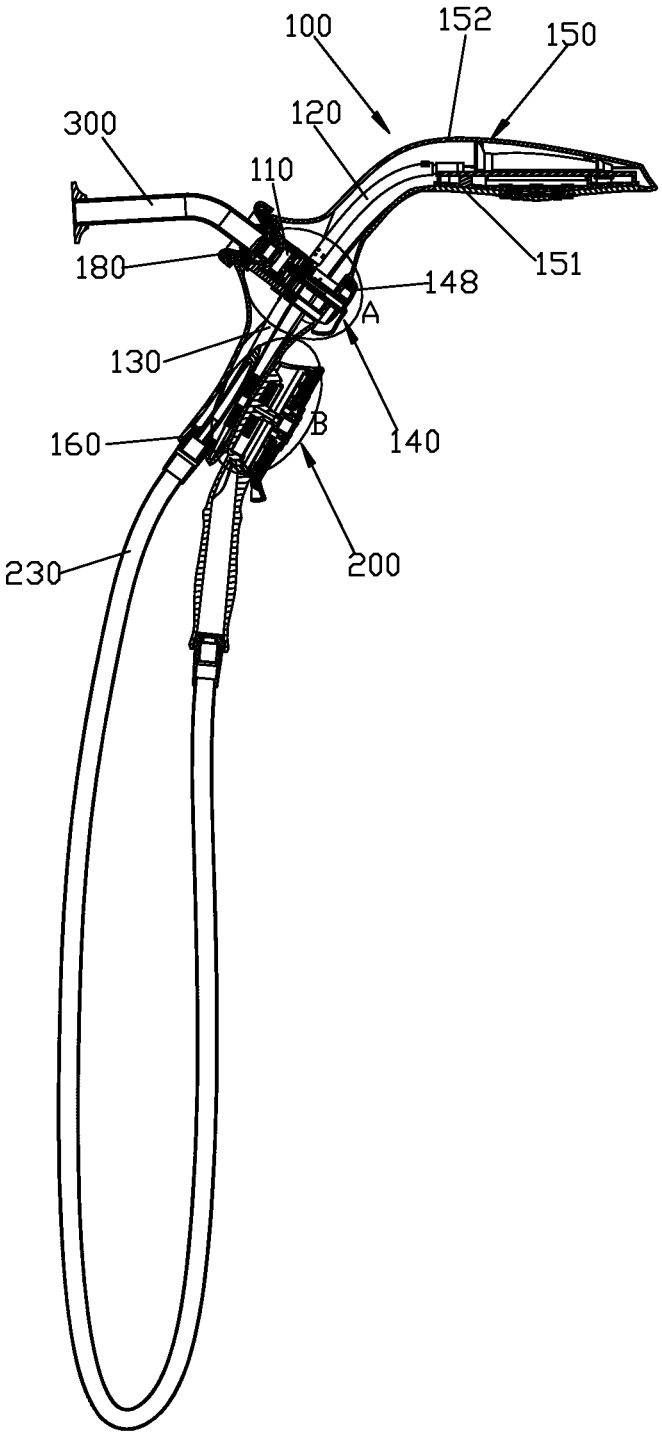
FIG. 2 illustrates a sectional view of the shower system.
Figure 3:
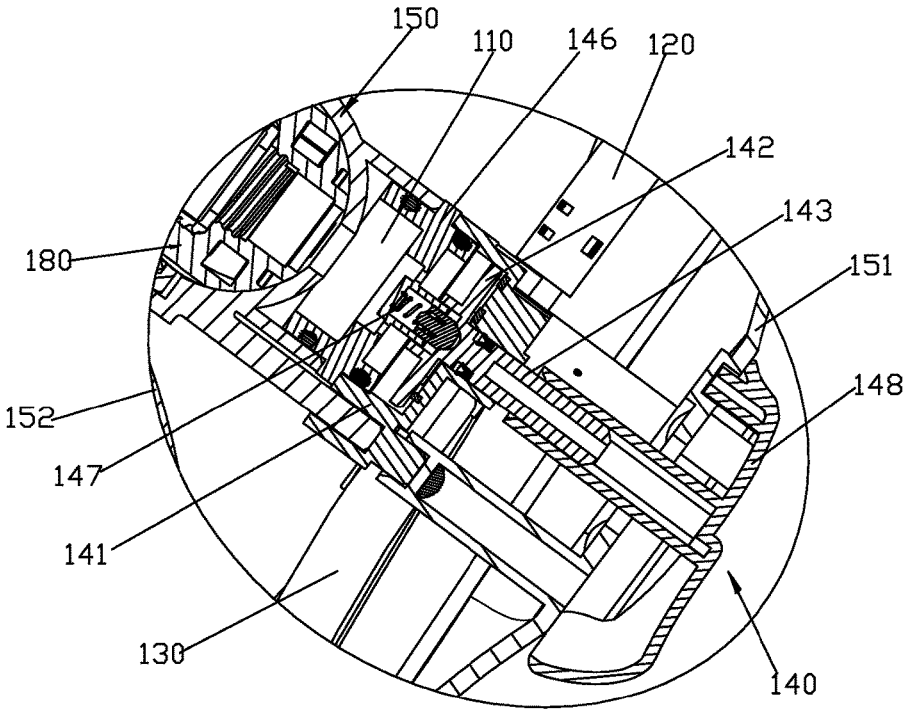
FIG. 3 illustrates an enlarging view of the A portion of FIG. 2.
Figure 4:
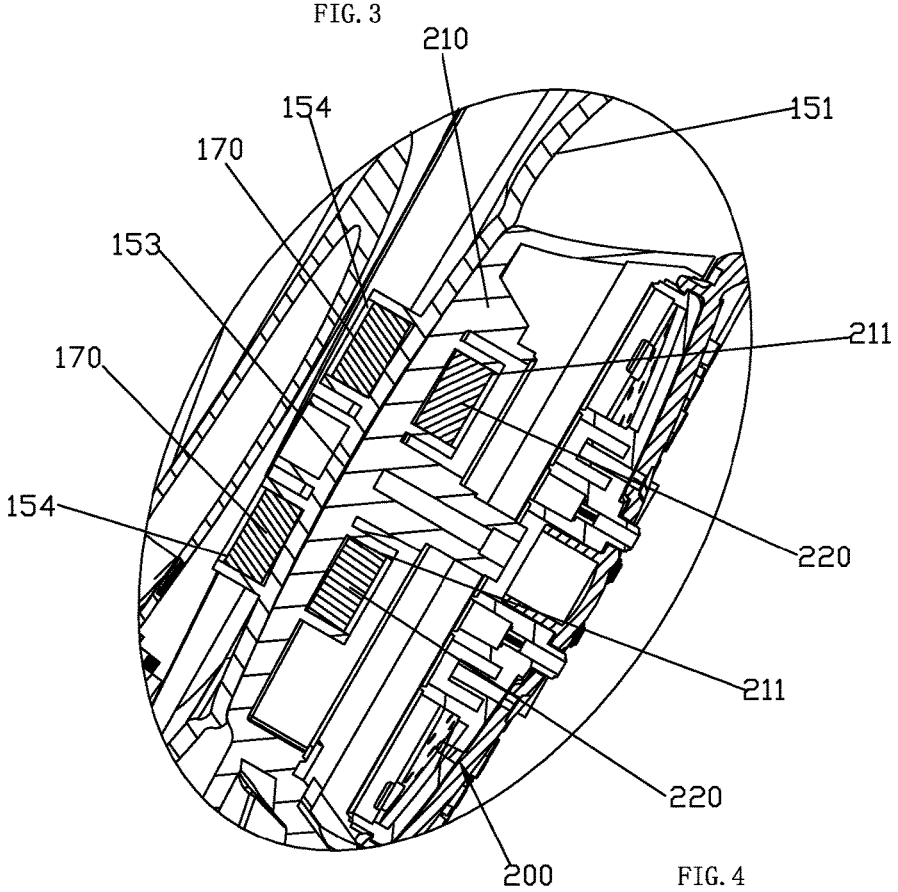
FIG. 4 illustrates an enlarging view of the B portion of FIG. 2.
Figure 5:
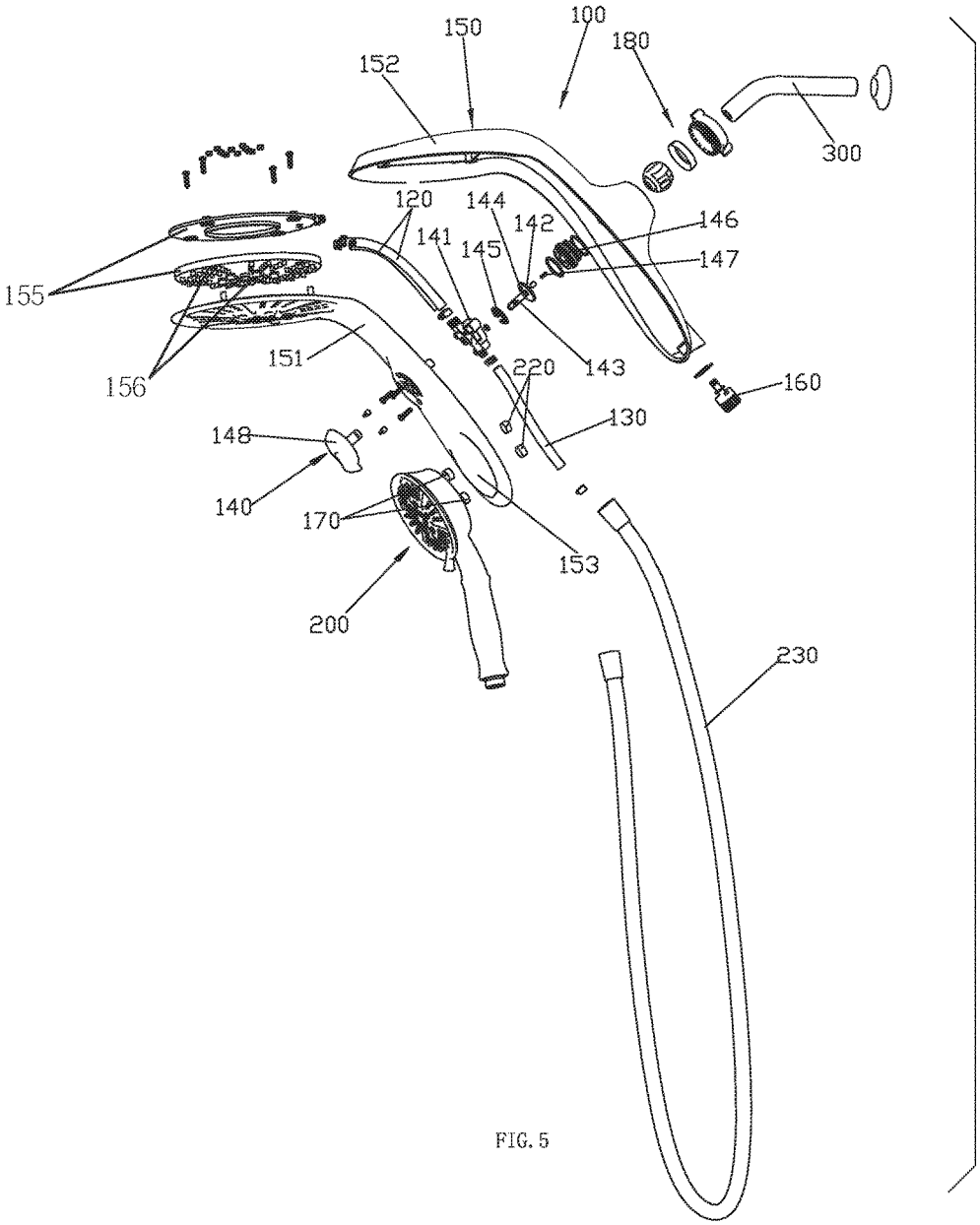
FIG. 5 illustrates a schematic and exploded diagram of the shower system.
Figure 6:
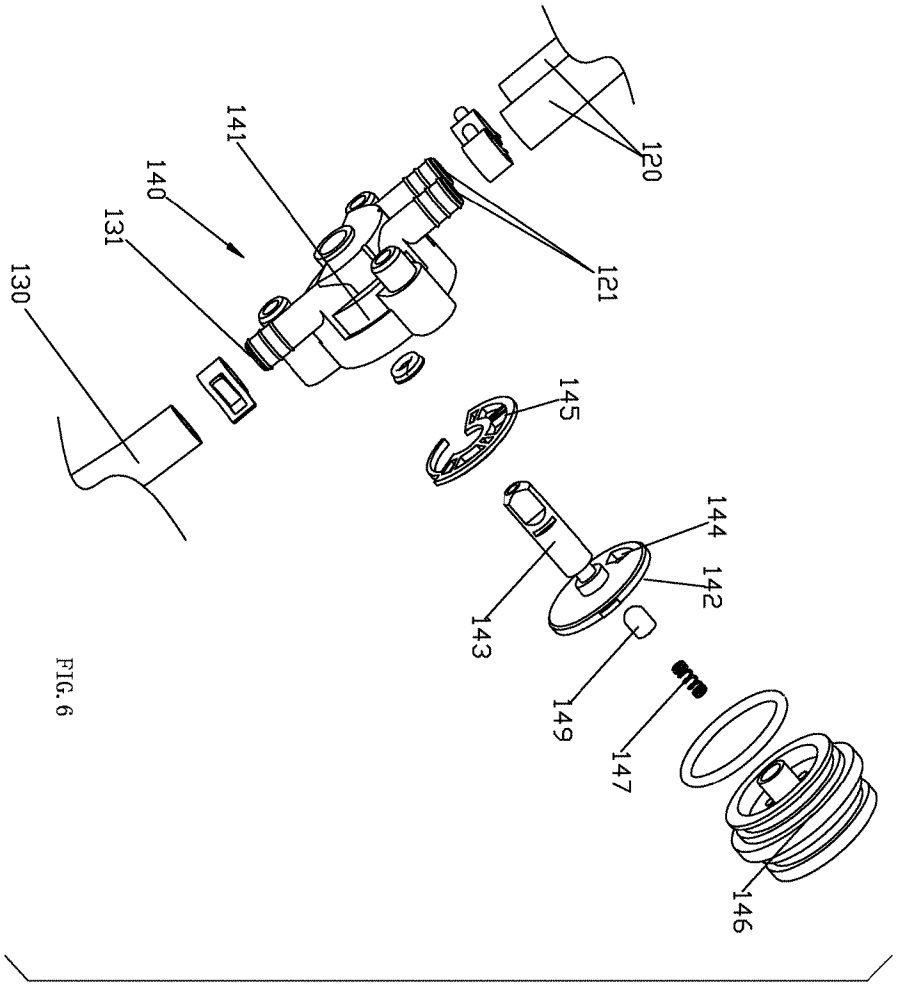
FIG. 6 illustrates a schematic and exploded diagram of the water diversion body, the water diversion plate and the press base.
Figure 7:
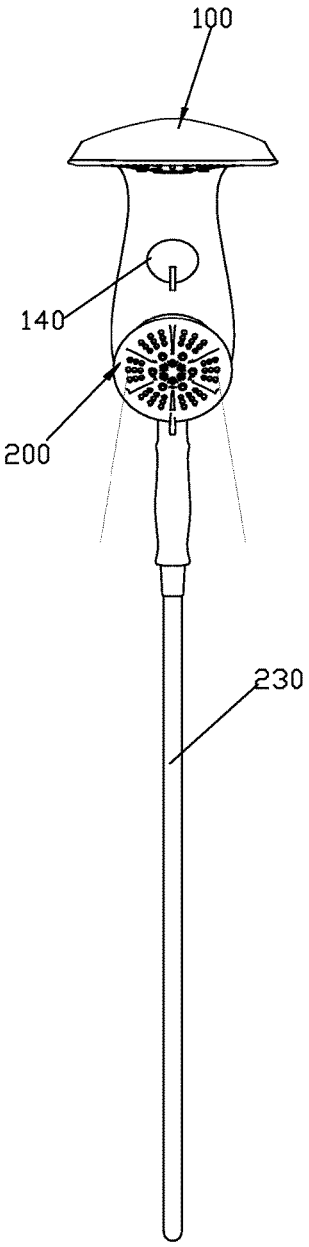
FIG. 7 illustrates a front view of the shower system when the hand shower is attracted to the top sprayer to form a head shower.
Figure 8:
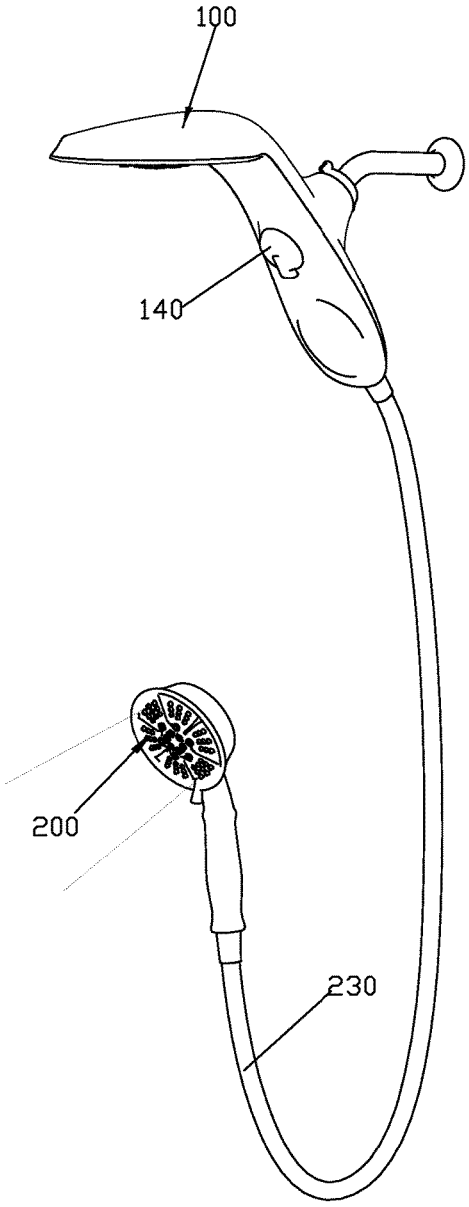
FIG. 8 illustrates a schematic diagram of the shower system when the hand shower is taken off to use.
Figure 9:
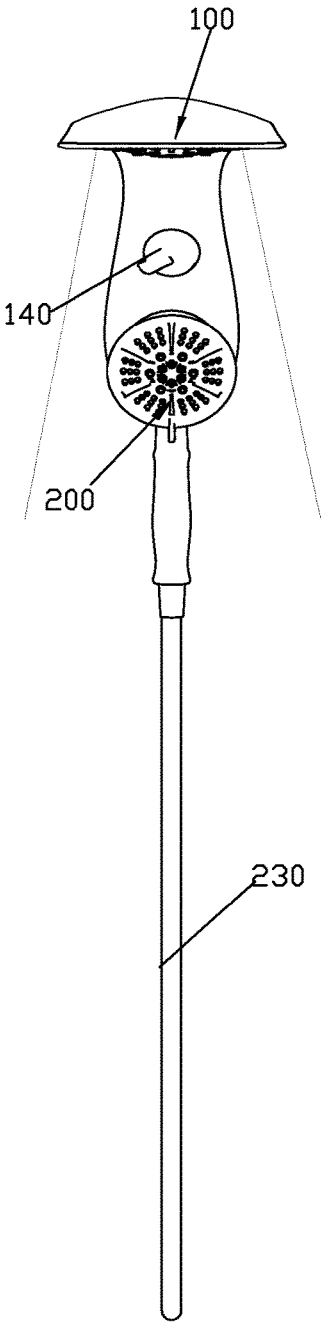
FIG. 9 illustrates a front view of the shower system when water flows out of the first water type of the top sprayer.
Figure 10:
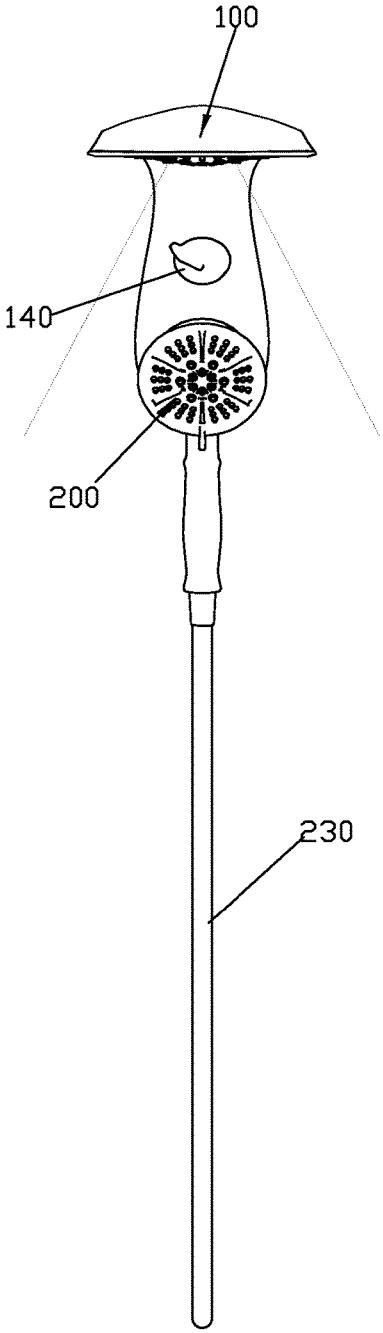
FIG. 10 illustrates a front view of the shower system when water flows out of the second water type of the top sprayer.

The top sprayer 100 is disposed with an inlet waterway 110 connected to the water source and a first diversion waterways 120 corresponding to the water types one by one, that is to say, the numbers of the first diversion waterways and the shower types are equal and are connected one by one; the top sprayer 100 is further disposed with a second diversion waterway 130, the hand shower 200 is connected to the second diversion waterway 130 by an external flexible pipe 230; the top sprayer 100 is disposed with a switch mechanism 140, which is cooperated to the inlet waterway 110, the first diversion waterway 120 and the second diversion waterway 130 to switch the waterways to alternately connect to the inlet waterway, as figured in FIG. 7 and FIG. 8, the second diversion waterway 130 is connected to the inlet waterway, so that water flows out of the hand shower 200, in other case, for example, as figured in FIG. 9, one first diversion waterway 120 is connected to the inlet waterway, so that water flows out of the first water type of the top sprayer 100, in another case, as figured in FIG. 10, another first diversion waterway 120 is connected to the inlet waterway, so that water flows out of the second water type of the top sprayer 100. as needed, the waterway switch can realize that two of the diversion waterways discharge water at the same time, or all diversion waterways are closed.

The top sprayer 100 comprising a fixed portion 150, the fixed portion 150 comprising a top sprayer front cover 151 and a top sprayer back cover 152, the top sprayer front cover 151 is fixed to the top sprayer back cover 152 face to face, an accommodating room forms inside; the switch mechanism 140 comprising a water diversion body 141 and a water diversion plate 142 fixed inside the accommodating room of the fixed portion; the water diversion body 141 is concaved with a concave cavity, the bottom surface of the concave cavity is disposed with at least two first water diversion openings 121 connected to the at least two first diversion waterways 120 and a second water diversion opening 131 connected to the second diversion waterway 130; the axis of the water diversion plate 142 is fixed with a shaft 143, the water diversion plate 142 is disposed with a throughout water diversion hole 144, which is connected to the inlet waterway 110; the water diversion plate 142 is rotatably connected inside the concave cavity of the water diversion body 141 in sealing way and is contacted to the bottom surface of the concave cavity, the shaft 142 rotatably passes through the bottom surface of the concave cavity of the water diversion body 141 and extends out of the water diversion body 141 in sealing way, for convenient to operate, a knob 148 is further disposed, the knob 148 comprising a rotating portion and a rotating handle fixed to the rotating portion, the rotating portion is disposed in front of the top sprayer top cover, the rotating handle rotatably passes through the top sprayer front cover and is fixed to the extending portion of the shaft 143 coaxially, it is fixed in axis, the knob, when rotating, drives the shaft to rotate The rotating portion is disposed outside the top sprayer front cover 151 of the fixed portion 150 for user to operate and switch, the shaft 143 rotates to drive the water diversion plate 142 to rotate, thus making the water diversion hole switched to connect to the first water diversion hole or the second water diversion hole, thus implementing switching. To ensure the switch accurate, preferred, a sealing pad 145 is disposed between the water diversion plate 142 and the bottom surface of the concave cavity. As needed, the shaft extends out of the top sprayer front cover, the knob is connected to the extended portion of the top sprayer front cover.

In another preferred embodiment, the top sprayer 100 further comprising a press base 146, the press base 146 is assembled to the concave cavity of the water diversion body 141, the water diversion plate 142 is disposed between the bottom surface of the concave cavity and the press base, a spring 147 abuts between the press base and the water diversion plate, so that the water diversion plate is closely contacted to the bottom surface of the concave cavity, thus ensuring the sealing performance; the press base 146 is disposed with a through hole inside, the inlet waterway comprising the through hole. To ensure of the abutting with reliability, preferred, one end of the spring 147 is assembled to the press base, while the other end is connected to a positioning pin 149, the positioning pin abuts the water diversion plate.

The top sprayer 100 is assembled to a hanging arm 300, the inlet waterway 110 is connected to the internal hole of the hanging arm 300, the hanging arm 300 is a pipe fixed to the wall and connected to the water resource. In this embodiment, the top sprayer back cover 152 is assembled to the hanging arm 300 and the inlet waterway 110 is connected to the internal hole of the hanging arm 300. The connecting mechanism 180 is applied with existing technology. Preferred, the top sprayer back cover 152 is disposed with a waterway, the connecting mechanism 180 leads water of the hanging arm to the waterway, the press base 146 is connected to the waterway in sealing way, the press base is connected to the water diversion body in sealing way to lead water to the concave cavity of the water diversion body, so that above waterway and through hole can be considered as part of the inlet waterway.

The fixed portion 150 comprising an outlet component 155, which comprises outlet portions 156 corresponding to the water types one by one, the first diversion waterway 120 is a first internal flexible pipe, the first internal flexible pipe is connected to the first water diversion openings and the outlet portions; the top sprayer 100 is disposed with a joint 160, the second diversion waterway 130 is a second internal flexible pipe, the second internal flexible pipe is connected to the second water diversion opening and the joint, the external flexible pipe is connected to the joint.

The front side of the top sprayer front cover 151 of the top sprayer 100 is disposed with a coupled surface 153 coupled to the hand shower, the back side of the top sprayer front cover corresponding to the coupled surface is disposed with a first accommodating base 154, which is disposed with a first magnetic unit 170 inside; the hand shower 200 is disposed with a back cover, the internal surface of the back cover 210 is disposed with a second accommodating base 211, which is disposed with a second magnetic unit 220. with the attraction of the first magnetic unit and the second magnetic unit, the hand shower can be attracted to the coupled surface of the top sprayer. In another preferred embodiment, the coupled surface is coupled to the back cover of the hand shower. With the magnetic attraction to connect the hand shower, it makes it convenient to hold, as we know it does not need to place the hand shower to the coupled surface with accurate, even when the back cover of the hand shower misses the coupled surface, under the work of the magnetic attractive force, the hand shower is attracted to the coupled surface; when the hand shower is near to the coupled surface, under the work of the magnetic attractive force, the hand shower is attracted to the coupled surface; in attracted state, the hand shower is movable for user to use. When used, for example the hand shower is attracted to the top sprayer, the hand shower is considered and used as a top shower, as figured in FIG. 7; get off the hand shower from the top sprayer, the hand shower is a traditional one, as figured in FIG. 8.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. A shower system, comprising:

an inlet waterway in communication with a water source;

a top sprayer connected to the inlet waterway, configured to provide at least two water types, and being comprised of:

a fixed portion comprising outlet components including at least two outlet portions corresponding to each of the at least two water types;

at least two first diversion waterways corresponding respectively to each of the at least two outlet portions;

a second diversion waterway; and a switch mechanism that comprises:

a water diversion body that is fixed inside the fixed portion, that has a fixing shaft that rotatably extends from the water diversion body to outside of the top sprayer in a sealing way, and that has defined therein at least two first water diversion openings that respectively communicate with the at least two first diversion waterways and a second water diversion opening that communicates with the second diversion waterway;

a rotatable actuator that extends partially outside of the fixed portion so as to be accessible and is coaxially fixed to the fixing shaft; and a water diversion plate that is rotatably positioned within the water diversion body and sealed, that has defined there through a water diversion hole that communicates with the inlet waterway, and that is fixed to the fixing shaft which, when rotated by the rotatable actuator, drives the water diversion plate to rotate, causing the water diversion hole to switch to communicate variously with the at least two first water diversion openings and the second water diversion opening; and a hand shower connected to the second diversion waterway by an external flexible pipe, wherein the switch mechanism cooperates with the inlet waterway, the at least two first diversion waterways and the second diversion waterway to switch output of the inlet waterway to either (a) one first diversion waterway only, (b) another first diversion waterway only, (c) the one and the another first diversion waterways together, (d) the one first diversion waterway and the second diversion waterway together, (e) the another first diversion waterway and the second diversion waterway together, or (f) the second diversion waterway only.

2. The shower system according to claim 1, wherein the rotatable actuator includes a knob that extends partially outside of the fixed portion so as to be accessible.

3. The shower system according to claim 2, wherein the water diversion body has a concave cavity, the water diversion plate is disposed inside the concave cavity, and the fixing shaft passes through a bottom surface of the concave cavity and extends out of the water diversion body, wherein the top sprayer has a press base that has a through hole defined therethrough, that is assembled to the concave cavity of the water diversion body, and the water diversion plate is disposed between the bottom surface of the concave cavity and the press base, wherein a spring is provided between and abuttingly engages the press base and the water diversion plate, and wherein the inlet waterway comprises the through hole defined in the press base.

4. The shower system according to claim 2, wherein the fixed portion comprises a top sprayer front cover and a top sprayer back cover, the top sprayer front cover being fixed to the top sprayer back cover face to face, wherein the water diversion body is disposed between the top sprayer front cover and the top sprayer back cover, and wherein the knob is disposed at a front portion of the top sprayer front cover.

5. The shower system according to claim 2, wherein each of the at least two first diversion waterways is a first internal flexible pipe that is connected to a respective one of the at least two first water diversion openings and to a respective one of the at least two outlet portions.

6. The shower system according to claim 2, wherein the top sprayer is provided with a joint, wherein the second diversion waterway is a second internal flexible pipe that is connected to the second water diversion opening and to the joint, and wherein the external flexible pipe is connected to the joint.

7. The shower system according to claim 1, wherein the top sprayer is assembled to a hanging arm that has defined therein an internal through hole, and the inlet waterway is connected to the internal through hole of the hanging arm.

8. The shower system according to claim 1, wherein the top sprayer is provided with a coupling surface to couple the top sprayer to the hand shower and with a first magnetic unit provided therein, and wherein the hand shower is provided with a second magnetic unit so that attraction of the first magnetic unit and the second magnetic unit attaches the hand shower to the coupling surface of the top sprayer.

9. The shower system according to claim 8, wherein the fixed portion comprises a top sprayer front cover having a front side and a back side; and a top sprayer back cover, the top sprayer front cover being fixed to the top sprayer back cover face to face, wherein the coupling surface is disposed on the front side of the top sprayer front cover, wherein the back side of the top sprayer front cover corresponding to the coupling surface is provided with a first accommodating base in which the first magnetic unit is disposed inside thereof, wherein the hand shower is provided with a back cover having an internal side provided with a second accommodating base in which the second magnetic unit is disposed inside thereof.

10. The shower system according to claim 9, wherein the coupling surface is coupled to the back cover of the hand shower.

* * * * *